US006594860B2

(12) United States Patent
Czipri

(10) Patent No.: US 6,594,860 B2
(45) Date of Patent: Jul. 22, 2003

(54) UNIVERSAL HINGE

(75) Inventor: John Czipri, Palm Harbor, FL (US)

(73) Assignee: Accon Marine, Inc, Clearwater, FL (US)

( * ) Notice: Subject to any disclaimer, the term of this patent is extended or adjusted under 35 U.S.C. 154(b) by 137 days.

(21) Appl. No.: 09/808,967

(22) Filed: Mar. 16, 2001

(65) Prior Publication Data

US 2002/0129465 A1 Sep. 19, 2002

(51) Int. Cl.[7] ..... E05D 3/10

(52) U.S. Cl. ..... 16/367; 16/258; 248/278.1; 114/364

(58) Field of Search ..... 16/367, 257, 258, 16/380, 381, 357–361, 231, 232; 248/519, 222.11, 222.13, 278.1, 408; 403/321, 322.1, 322.4, 324, 325, 164, 165, 119, 120; 114/249, 250, 253, 364; 135/88.15

(56) References Cited

U.S. PATENT DOCUMENTS 1,396,247 A * 11/1921 Bowman ..... 472/4
1,903,379 A 4/1933 Hall
4,319,746 A * 3/1982 Chang ..... 472/4
4,455,008 A * 6/1984 MacKew ..... 248/447.1
4,799,444 A * 1/1989 Lisowski ..... 114/221 R
4,843,680 A 7/1989 Cress
5,092,262 A * 3/1992 Lacy ..... 114/343
5,233,726 A 8/1993 Cress
5,392,493 A 2/1995 Youngdale
5,413,063 A * 5/1995 King ..... 114/221 R
5,850,997 A * 12/1998 Rosen ..... 248/222.11
5,873,149 A 2/1999 Bonenberger
6,138,970 A * 10/2000 Sohrt et al. ..... 248/278.1
6,151,756 A 11/2000 Czipri
6,220,556 B1 * 4/2001 Sohrt et al. ..... 248/278.1
6,367,756 B1 * 4/2002 Wang ..... 248/276.1

* cited by examiner

*Primary Examiner*—Anthony Knight
*Assistant Examiner*—Doug Hutton
(74) *Attorney, Agent, or Firm*—Harold D. Shall

(57) ABSTRACT

A universal hinge with a base member having a smooth semi spherical upper surface and a lower mounting surface and a vertically extending cylindrical opening therein. An intermediate member has a lower cylindrical surface that is received in the base member, and a latching member carried by the base member secures the intermediate member to the base member for relative rotation. The remote end of the intermediate member is pivotally secured to a mounted member, and the remote end of the latter is formed for securement of an item such as a Bimini Top.

10 Claims, 2 Drawing Sheets

UNIVERSAL HINGE

BACKGROUND OF THE INVENTION

1) Field of the Invention

This invention relates generally to hinges, and more particularly to a universal hinge that will accommodate relative movement between the hinge members in more than a single plane.

2) Description of the Prior Art

Universal hinges are well known in the prior art and have particular application, inter alia, as a hinge for a convertible Bimini Top of a boat, that is a type of convertible top which can be raised to an upright usable position and lowered therefrom to a lowered unused or stored position. Such a hinge must have a base which can be mounted on a vessel, and a part carried by and pivotal relative to the base and securable to the Bimini top so that the Bimini Top can be moved between its positions. Such a Bimini hinge is shown in my U.S. Pat. No. 6,151,756, which has these desirable characteristics, however, this hinge requires that a receiving opening be provided in the boat hull to accommodate the housing which depends from the mounting flange. All boat manufacturers do not desire to have such an opening in their boat and all boat mounting surfaces are not conducive to having a receiving opening therein. Additionally, the two parts of the hinge are not easily separated, so that when a Bimini is removed from the prior art hinge, as for storage, the Bimini is detached from the hinge and the two portions of the hinge remain secured to the boat. In this condition the pivoting portion of the hinge projects from the base and becomes an obstruction for becomes an obstruction for the boat operator, as disassembly of the hinge is difficult.

SUMMARY OF THE INVENTION

It is an object of this invention to provide a universal hinge wherein the base of the hinge does not project below the surface upon which it is mounted. It is also an object of this invention to provide a universal hinge wherein the hinge elements are easily dissembled. Yet a further object of this invention is to provide such a hinge structure such that when the pivoting portion is removed from the base portion, there is no structure present to interfere with a user. To this end, the present invention includes a base which is securable to a surface such as a boat hull or cabin, and does not project below this surface. The base has a receiving opening therein, and includes a latching lever which is spring loaded to project into the receiving opening and which lever is manually operable to be withdrawn from the projecting position. A hinge intermediate member is rotatably received in the receiving opening and has a detent groove for receiving the latching lever to retain the intermediate member in the opening, and alternately, when the latch is withdrawn, to be removed from the opening to disassemble the parts. The intermediate member has an axial slot there in for pivotally receiving a tang carried by the mounted member to be mounted thereon, and a pivot pin transverses the slot and the tang to pivotally mount the mounted member to the intermediate member, whereby the mounted member is universally hinged relative to the base.

DETAILED DESCRIPTION OF THE INVENTION

Figure 1:
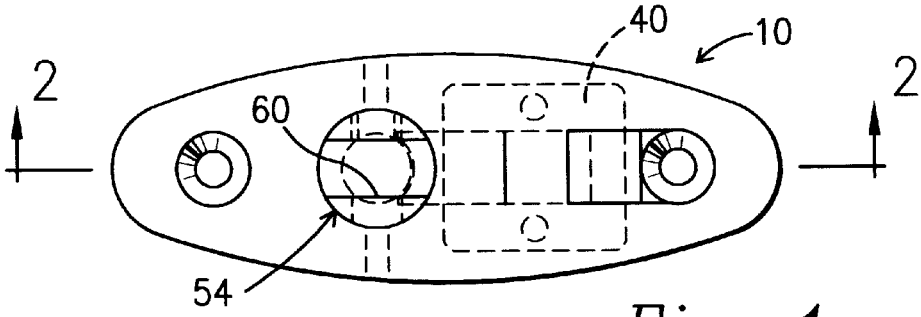
FIG. 1 is a plan view of a hinge of this invention with the mounted member omitted for clarity.
Figure 2:
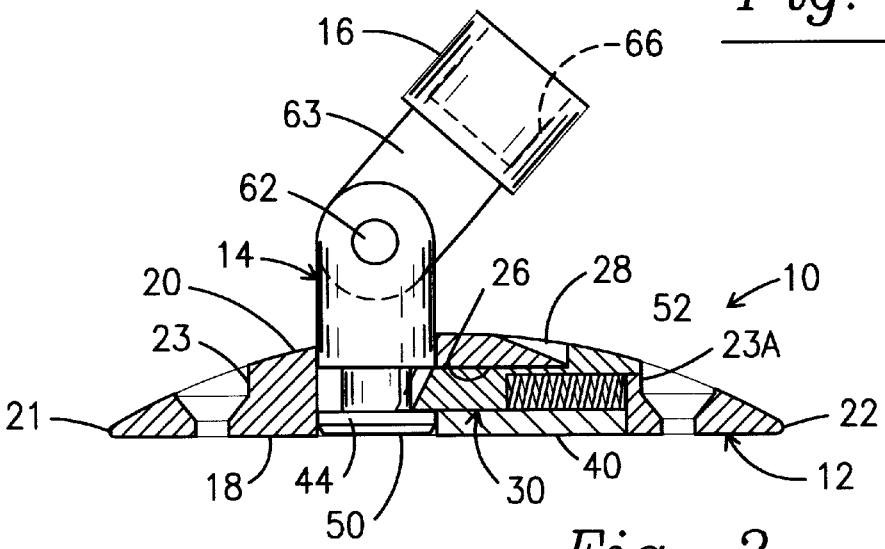
FIG. 2 is a cross sectional view taken along the line 2—2 in FIG. 1 with the mounted member included, and with the mounted member and intermediate member shown in full lines.
Figure 3:
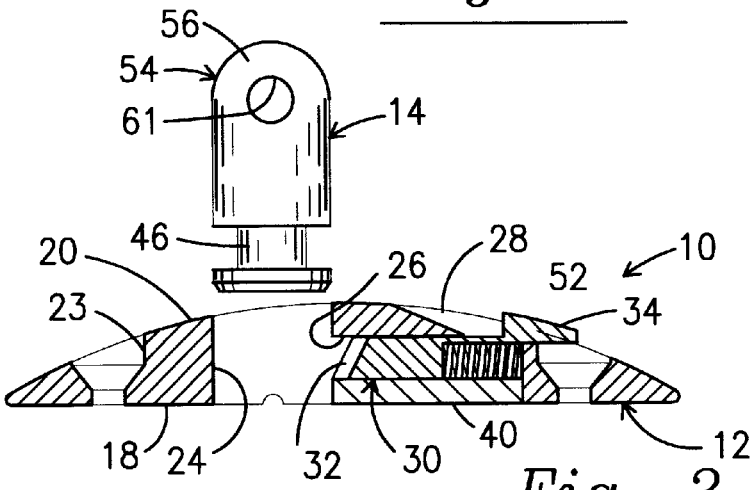
FIG. 3 is a cross sectional view also taken along the line 2—2 in FIG. 1 with the intermediate member shown in full lines and removed from the base.
Figure 4:
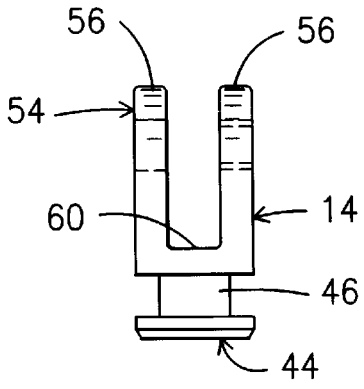
FIG. 4 is an end view of the intermediate member.
Figure 5:
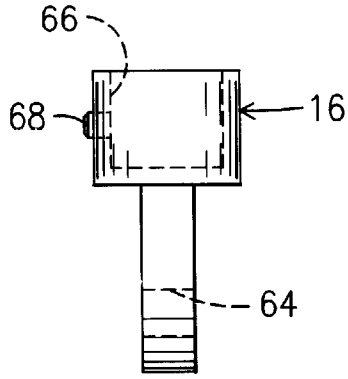
FIG. 5 is an end view of the mounted member.
Figure 6:
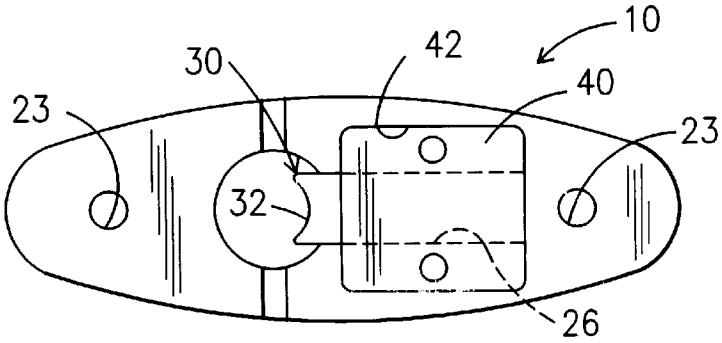
FIG. 6 is a bottom view of the device of FIG. 1.
Figure 7:
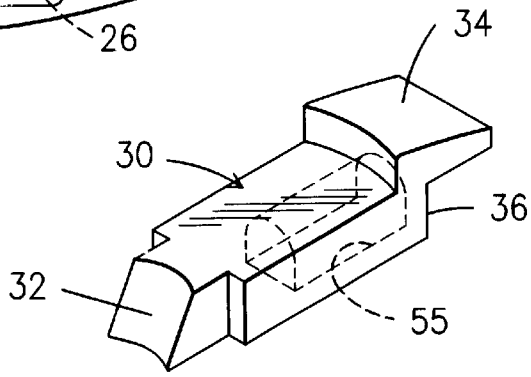
FIG. 7 is a perspective view of the latching lever of this invention.

Referring now to the drawings, a hinge of this invention, configured as a Bimini hinge for a boat, is shown generally at 10 and includes a base 12, an intermediate member 14, and a mounted member 16. The base 12 has a flat bottom 18 and a generally spherically configured top surface 20, which surface, in itself, is smooth and unobtrusive, so as present no sharp points which can cause an injury. Adjacent each of its axially opposed ends 21 and 22, the base 12 is provided with a countersunk bolt receiving opening 23 at its forward end and 23A at its rearward end, adapted to receive a bolt to secure the base to a surface on a boat hull.(not shown). The base 12 has a vertically extending cylindrical mounting opening 24 machined therethrough disposed slightly forward of its center, and a slot 26 is formed in the bottom 18 thereof. The slot 26 commences just forwardly of the rear bolt receiving opening 23A and extends to, and opens into the mounting opening 24. The rear end of the slot also opens into a depression 28 formed in the top surface of the base 12, which depression commences just rearwardly of the opening 24 and terminates at the countersunk portion of the rear countersunk opening 23A. A latching lever 30 is received in the slot 26, and has a latching left end 32 and a manually operable knob 34 formed on the right end 36 thereof, which knob projects from the slot 26 and is accessible in the depression 28. The lever 30, in a vertical direction, is spaced slightly above the bottom 18 of the base 12, and a cover plate 40, tightly received in a depression 42 and substantially coplanar with the bottom of the base member 12, covers the bottom of the slot 26 and retains the lever 30 in the slot 26. The latching left end 32 of the lever 30 is inclined downwardly to the left for a purpose hereinafter explained.

The intermediate member 14 has a cylindrical lower end 44, in which, at a location adjacent to the lower end thereof, an annular detent groove 46 is formed, which groove is of sufficient vertical height so as to be capable of receiving the left end 32 of the latching member 30. The lower end 44 has a chamfer 50 formed on the extreme end thereof, so that when the member 14 is slid into the base 12, the lower end 44 will engage the left inclined end 32 of the latching member 30, and move the latter to the right against the biasing effect of a coil compression spring 52, received in a pocket 55 formed in the bottom of the latching member, and compressed between the latter and the right end of the slot 26, to thereby bias the latching member 30 to the left. With the member 30 moved to the right, the intermediate member 14 can move into the base 12 until the bottom thereof is flush with the bottom 18 of the base, and the end 32 of the latching member 30 is biased into the annular groove 46 of the member 14, and since the bottom 44 of the member 14 is cylindrical, the intermediate member 14 is free to rotate about its vertical axis in the base 12 while being restrained from moving vertically by the latching member 30. The upper end 54 of the intermediate member 14 is bifurcated with a pair of spaced arms 56 formed by a vertically extending central slot 60 which extends inwardly from the upper end thereof and ends at a location which is generally in registration with the top of the base 12 at such time as the member 14 is mounted in the base 12. The arms 56 each has an opening 61 formed therein, which openings are in alignment and securely receive a pivot pin 62 therein. The mounted member 16 has a tang 63 received in the slot 60 between the pair of arms 56, with the pivot pin 62 received in an opening 64 in the tang 63 to pivotally mount the mounted member 16 to the intermediate member 14. The mounted member 16 has a central opening 66 extending inwardly from the upper end thereof for receiving the mounting leg (not shown) of a conventional Bimini Top (not shown), and a set screw 68 threaded into the side of the mounting member and reaching into the opening 66 is operable to secure the mounting leg to the mounting member 16.

In order to store the Bimini, the latching lever 30 is moved to the right so that it is withdrawn from the slot 46 in the intermediate member 14, so that the intermediate member can be withdrawn from the base 12, and the Bimini stored with the intermediate member and the mounted member 16 secured thereto. This leaves behind on the vessel only the base 12 with its smooth semi spherical upper surface exposed, which is not likely to injure a boat occupant. If desired, the mounted member 16 can be removed from the Bimini by loosening the set screw 68, and the intermediate member and the mounted member returned to the base with or without the Bimini attached thereto for whatever reason such may be desired.

While only a single embodiment of this invention has been shown and described, it is understood that many changes can be made therein without departing from the scope of this invention as claimed.

What is claimed is:

1. A universal hinge that will accommodate relative movement between its parts in more than a single plane, comprising, A) a base member adapted to be mounted on a surface and having a mounting opening therein, B) an intermediate member having a first portion thereof mounted in said mounting opening and a second portion thereof projecting from said base member, C) quick release means securing said intermediate member to said base member and allowing relative movement therebetween solely in a first plane, and D) a mounted member including means mounting the same to said intermediate member for pivotal movement relative thereto in a second plane at right angle to said first plane, 1) said mounted member having a portion thereof formed as a mounting location for an item to be mounted thereon for universal pivotal movement relative to said base member.

2. A universal hinge comprising in combination,

A) a base member having a bottom engageable surface and having a mounting opening therein, B an intermediate member having a first portion thereof received in said opening for relative rotative movement, C) quick release means for securing said intermediate member to said base member and solely allowing relative rotative movement to take place, D) said intermediate member having a second portion thereof remote from said first portion thereof, and E) a mounted member including means connecting said mounted member to said intermediate member for relative pivotal movement.

3. A universal hinge according to claim 2 wherein said quick release means includes a latching member carried by said base member and resilient means also carried by said base member for biasing said latching member into latching engagement with said intermediate member.

4. A universal hinge according to claim 3 wherein said base member has an upper surface opposed to the bottom surface thereof, said mounting opening is at right angles to said bottom surface, said base member has a slot therein, said slot is open at one end thereof into said mounting opening and open at an other end thereof at said upper surface of said base member, and said latching member is disposed in said slot.

5. A universal hinge according to claim 4 wherein said mounting opening is cylindrical, the first portion of said intermediate member received therein is also cylindrical, said intermediate member has an annular groove therein, and said annular groove is formed in the cylindrical portion of said intermediate member.

6. A hinge according to claim 3 wherein said intermediate member has an annular groove therein and a first end of said latching member is receivable into said groove.

7. A hinge according to claim 6 wherein said latching member has a second end opposed to said first end, and said second end projects to the upper surface of said base member, and is adapted for manual manipulation.

8. A hinge according to claim 7 wherein said base member has a slot therein, said slot is open to said bottom surface of said base member, and a cover plate is securely carried by said base member and covers the portion of said slot open at said bottom surface of said base member.

9. A hinge according to claim 8, wherein said base member has a cover plate receiving opening in the bottom surface thereof, said cover plate is received in said receiving opening so as to be flush with said bottom surface of said base member.

10. A hinge according to claim 2 wherein said intermediate member has a remote end and has a pivot slot formed in said remote end thereof, said mounted member has a tang thereon received in said pivot slot, and a pivot pin pivotly connects said intermediate and mounted members.

* * * * *